US010369441B2

(12) United States Patent
Pope et al.

(10) Patent No.: US 10,369,441 B2
(45) Date of Patent: Aug. 6, 2019

(54) GOLF CLUB HEAD WITH HIDDEN SCREW PORT

(71) Applicant: Karsten Manufacturing Corporation, Phoenix, AZ (US)

(72) Inventors: Jeremy Pope, Phoenix, AZ (US); Daniel K. Lee, Chandler, AZ (US); Martin R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/109,666

(22) Filed: Aug. 22, 2018

(65) Prior Publication Data

US 2019/0060726 A1 Feb. 28, 2019

Related U.S. Application Data

(60) Provisional application No. 62/548,870, filed on Aug. 22, 2017.

(51) Int. Cl.

| | |
|---|---|
| ***A63B 53/04*** | (2015.01) |
| ***A63B 60/02*** | (2015.01) |
| *A63B 53/06* | (2015.01) |

(52) U.S. Cl.

CPC ..... *A63B 60/02* (2015.10); *A63B 53/047* (2013.01); *A63B 53/0466* (2013.01); *A63B 53/065* (2013.01); *A63B 2053/0491* (2013.01)

(58) Field of Classification Search

CPC . A63B 53/047; A63B 53/065; A63B 53/0466; A63B 53/04; A63B 53/0487; A63B 2053/0491; A63B 60/02

See application file for complete search history.

(56) References Cited

U.S. PATENT DOCUMENTS

| | | | | |
|---|---|---|---|---|
| 5,325,630 | A | 7/1994 | Allenbaugh | |
| 5,653,564 | A | 8/1997 | Nakamura | |
| 6,676,177 | B2 | 1/2004 | Daoud et al. | |
| 6,773,360 | B2 | 8/2004 | Willett et al. | |
| 8,435,623 | B2 | 5/2013 | Jundt et al. | |
| 9,308,423 | B1 * | 4/2016 | Tang | A63B 53/06 |

(Continued)

FOREIGN PATENT DOCUMENTS

| | | |
|---|---|---|
| CN | 202065302 | 12/2011 |
| CN | 203230687 | 10/2013 |

(Continued)

*Primary Examiner* — John E Simms, Jr.

(57) ABSTRACT

Embodiments of a golf club head are described herein including a plurality of ports with doors. The golf club head comprises a ball striking face and a body, wherein the body comprises a plurality of ports each adapted to receive a threaded fastener and defines an outer surface of the golf club head. The plurality of ports comprises a bore recessed inward relative to the outer surface of the body, wherein the bore is fluidly isolated from the internal volume, wherein the bore is adapted to receive a threaded fastener; and a door hingably coupled to the body and pivotable between a first position that is substantially flush with the outer surface and a second position that is deflected inward of the outer surface; wherein the door at least partially blocks ingress of the threaded fastener into the bore when in the first position, and permits ingress of the threaded fastener into the bore when in the second position.

20 Claims, 3 Drawing Sheets

(56) References Cited

U.S. PATENT DOCUMENTS

| | | | | |
|---|---|---|---|---|
| 9,550,097 | B1 * | 1/2017 | Myers | A63B 53/0466 |
| 9,873,029 | B1 * | 1/2018 | Sillies | A63B 60/02 |
| 2014/0113742 | A1 * | 4/2014 | Zimmerman | A63B 53/04 473/335 |
| 2018/0056154 | A1 * | 3/2018 | Wallin | A63B 60/02 |

FOREIGN PATENT DOCUMENTS

| | | |
|---|---|---|
| EP | 2505857 | 10/2012 |
| GB | 811389 | 4/1959 |
| GB | 2383391 | 6/2003 |
| JP | 2012233532 | 11/2012 |
| JP | 5794841 | 1/2013 |
| JP | 2016180426 | 10/2016 |

* cited by examiner

GOLF CLUB HEAD WITH HIDDEN SCREW PORT

CROSS-REFERENCE TO RELATED APPLICATIONS

This claims the benefit of U.S. Provisional Patent Appl. No. 62/548,870, filed on Aug. 22, 2017, the content of which are fully incorporated herein by reference.

TECHNICAL FIELD

The present invention relates generally to a golf club head with a hidden port for attaching a weight member.

BACKGROUND

In an ideal club design, for a constant total swing weight, the amount of structural mass would be minimized (without sacrificing resiliency) to provide a designer with additional discretionary mass to specifically place in an effort to customize club performance. In general, the total of all club head mass is the sum of the total amount of structural mass and the total amount of discretionary mass. Structural mass generally refers to the mass of the materials that are required to provide the club head with the structural resilience needed to withstand repeated impacts. Structural mass is highly design-dependent, and provides a designer with a relatively low amount of control over specific mass distribution. Conversely, discretionary mass is any additional mass (beyond the minimum structural requirements) that may be added to the club head design for the sole purpose of customizing the performance and/or forgiveness of the club.

In many club head designs, discretionary weight may be affixed to the body of the club head by screwing the weight into a threaded port provided on the club head. If a user elects not to utilize additional weight, or to utilize fewer than all available threaded ports, then the unused ports are typically left open where they are susceptible to being impacted with dirt or debris.

DETAILED DESCRIPTION

Figure 1:
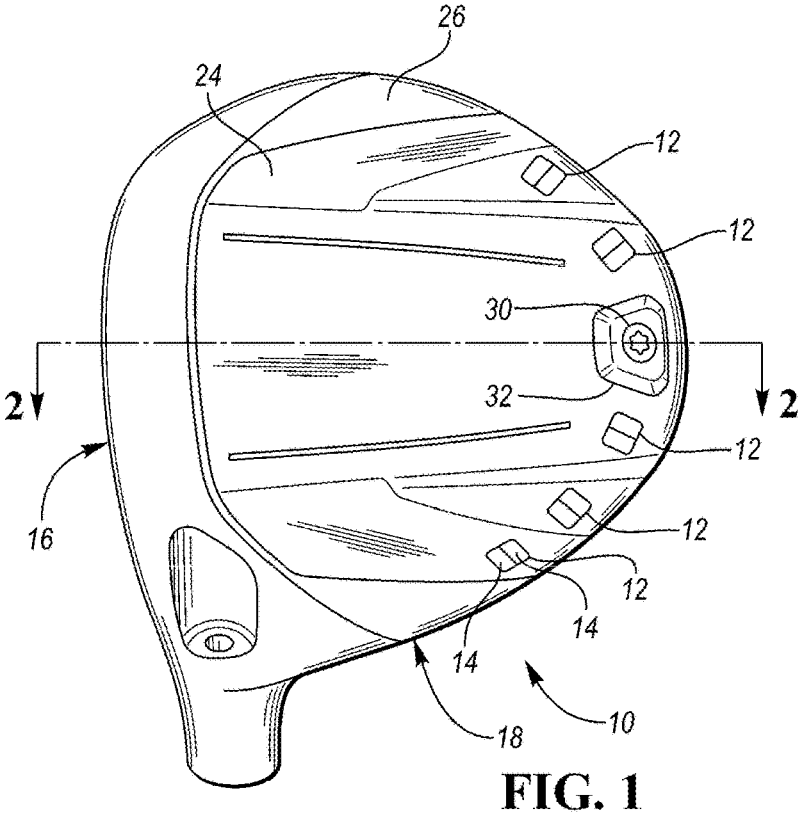
FIG. 1 is a schematic perspective view of the underside of a golf club head

The embodiments described below are directed to a golf club head that includes one or more hidden screw ports for selectively receiving discretionary weight. Each hidden screw port may include a surface that is recessed inward from the outer contour of the golf club head, a bore extending inward from the recessed surface, and a door that is hingably coupled to the body to selectively cover the bore. When a port is not in use (i.e., a weight is not threadably affixed into the port), the door may be biased to cover/hide the bore. In doing so, the door may inhibit dirt or debris from entering the bore while also improving the aerodynamics of the club head (i.e., when compared with an open bore). Additionally, the door may provide a low weight-penalty option for sealing the bore, as compared with installing a dummy screw.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

In many embodiments, the golf club head described below can be a driver type golf club head. The driver type club head can have a loft angle less than approximately 16 degrees, less than approximately 15 degrees, less than approximately 14 degrees, less than approximately 13 degrees, less than approximately 12 degrees, less than approximately 11 degrees, less than approximately 10 degrees, less than approximately 9 degrees, or less than approximately 8 degrees. Further, in many embodiments, the volume of the driver type golf club head is greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver type golf club head can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

In many embodiments, the golf club head described below can be a fairway wood type golf club head. In many embodiments, the loft angle of the fairway wood type golf club head is less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the fairway wood type club head is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. In some embodiments, the loft angle of the fairway wood type golf club head can be between 12 degrees and 35 degrees, between 15 degrees and 35 degrees, between 20 degrees and 35 degrees, or between 12 degrees and 30 degrees. In many embodiments, the volume of the fairway wood type golf club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood type golf club head can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

In many embodiments, the golf club head described below can be a hybrid type golf club head. In many embodiments, the loft angle of the hybrid type golf club head is less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid type golf club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees. In many embodiments, the volume of the hybrid type club head is less than approximately 200 cc, less than approximately 175 cc, less than approximately 150 cc, less than approximately 125 cc, less than approximately 100 cc, or less than approximately 75 cc. In some embodiments, the volume of the hybrid type golf club head can be approximately 100 cc-150 cc, approximately 75 cc-150 cc, approximately 100 cc-125 cc, or approximately 75 cc-125 cc.

In many embodiments, the golf club head described below can be a putter type golf club head. In many embodiments, the putter type golf club head can have a loft angle less than 9 degrees. In many embodiments, the loft angle of the club head can be between 0 and 5 degrees, between 0 and 6 degrees, between 0 and 7 degrees, or between 0 and 8 degrees. For example, the loft angle of the putter type club head can be less than 10 degrees, less than 9 degrees, less than 8 degrees, less than 7 degrees, less than 6 degrees, or less than 5 degrees. For further example, the loft angle of the putter type golf club head can be 0 degrees, 1 degree, 2 degrees, 3 degrees, 4 degrees, 5 degrees, 6 degrees, 7 degrees, 8 degrees, or 9 degrees.

Referring to the drawings, wherein like reference numerals are used to identify like or identical components in the various views, FIG. 1 schematically illustrates a perspective view of a golf club head 10 that includes a self-closing attachment port 12. As will be described below, this port 12 may be used to selectively attach a removable, discretionary weight to the club head 10, such as via a threaded fastener. When not in use (i.e., when no weight is attached), the port 12 may have an integral cover/door 14 that extends across at least a portion of the opening to inhibit the ingress of dirt or debris into the port 12.

With continued reference to FIG. 1, the golf club head 10 includes a ball striking face 16 ("strike face 16") and a body 18 that extends rearward from the strike face 16. As is well understood, the strike face 16 is the surface of the club head 10 that is intended to impact a golf ball during a typical swing. As generally illustrated in FIG. 2, in an embodiment where the golf club head 10 is a wood-style club, the strike face 16 and the body 18 may cooperate to at least partially define a closed internal volume 20 therebetween.

Figure 2:
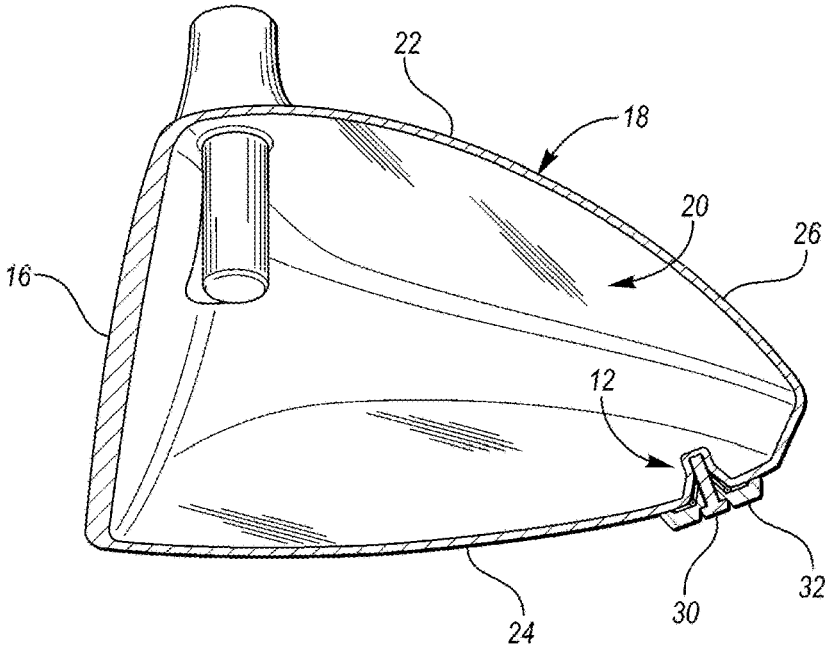
FIG. 2 is a schematic cross-sectional view of the golf club head of FIG. 1, taken along line 2-2.

As further illustrated in FIG. 2, in a wood-style club, the body 18 may generally define an upper portion referred to as the "crown" 22, and a lower portion referred to as the "sole" 24. For the purposes of this disclosure, the crown 22 may meet the sole 24 generally along an outer perimeter of the body 18 where the surface tangent is about perpendicular relative to a horizontal ground plane (i.e., when the club head 10 is held in a neutral hitting position according to prescribed loft and lie angles). As is common with most metal-woods, the body 18 may generally be a thin-walled, hollow structure that includes a substantially continuous outer surface 26, which defines a general outer contour of the golf club head 10.

As generally shown in FIG. 1, the golf club head 10 may include at least one port 12 that may be used to selectively attach a removable, discretionary weight 32 to the club head 10. In some embodiments, the golf club head 10 may include two or more ports 12, four or more ports 12, or as shown in FIG. 1, six or more ports 12. In embodiments where there are a plurality of ports 12, it may be possible to affix discretionary weights to fewer than all available ports. In such a configuration, if the unused port is not protected/sealed, there is a risk that dirt or other debris may become trapped in the unused attachment ports during normal use/play. Any lodged dirt/debris may then impair the future use of the port by interfering with the ability to secure weights in place.

Figure 3:
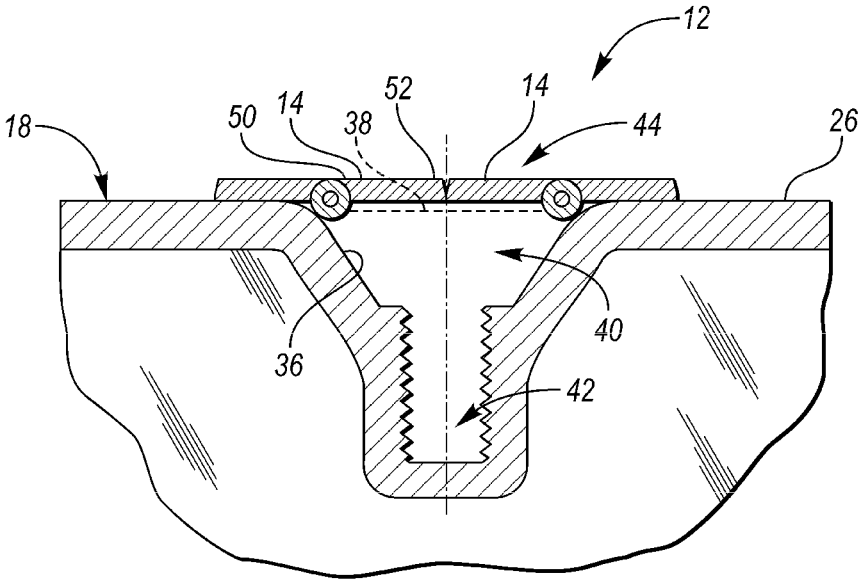
FIG. 3 is a schematic partial cross-sectional view of a golf club head with a hidden screw port.
Figure 4:
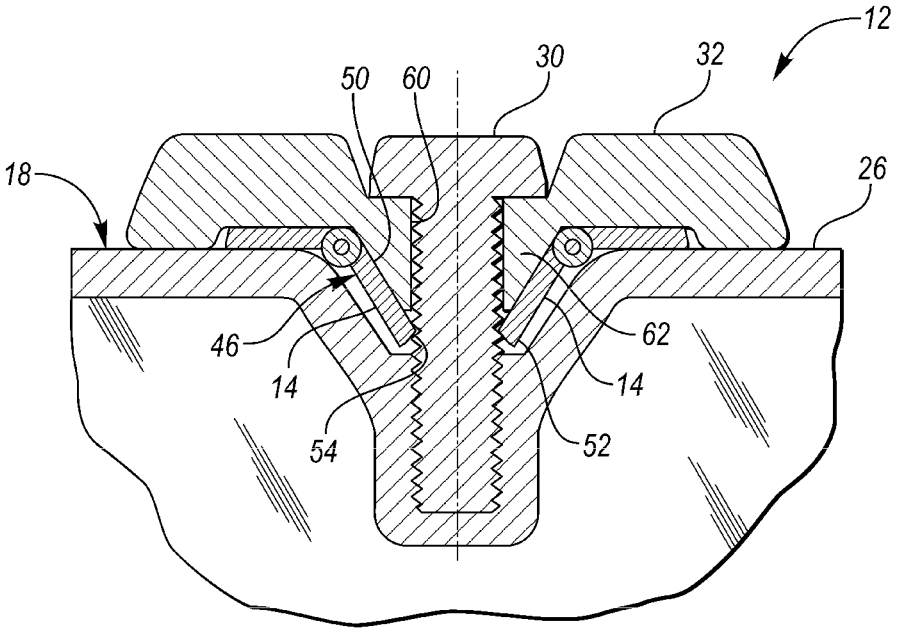
FIG. 4 is a schematic partial cross-sectional view of the golf club head of FIG. 3 with a discretionary weight affixed to the club head via a threaded fastener.

To protect against dirt or debris becoming lodged or impacted into an unused port 12, each port 12 may be provided with an integral cover/door 14 that extends across at least a portion of the opening. FIG. 3 provides an enlarged view of an unused port 12, while FIG. 4 schematically illustrates the same port with a threaded fastener 30 used to secure a discretionary weight 32 relative to the outer surface 26 of the body 18.

As generally shown in FIG. 3, in one embodiment the port 12 may include a recessed surface 36 that extends inward from the outer surface 26 of the body 18. The intersection of the recessed surface 36 and the outer surface 26 may generally define the opening 38 of the port 12 (i.e., where the opening 38 is generally the threshold provided flush with the outer contour of the golf club head 10 such that a recessed volume 40 is defined between the threshold opening 38 and the recessed surface 36). In some embodiments, a bore 42 may extend through a portion of the recessed surface 36, yet may still be recessed inward from the opening 38 and/or outer surface 26. To prevent water or other fluid from becoming trapped within the internal volume 20 of the club head 10, it is preferable for the bore 42 to be fluidly isolated from the internal volume 20, such as by having a closed end on the interior side of the bore 42.

The port 12 further includes at least one door 14 that is hingably coupled to the body 18 and pivotable between a first position 44 (shown in FIG. 3) that extends across at least a portion of the opening 38 and a second position 46 (shown in FIG. 4) that extends into the recess 40. In most embodiments, the port 12 includes at least two doors 14 that cooperate to entirely cover the opening 38 when in the first position 44. Each door 14 may include a hinged end 50 at which the door 14 is pivotably coupled to the body 18, and an opposite free end 52 that extends over the recess 40. In some embodiments, a port 12 may include three doors 14, each hingably coupled to the body (e.g., potentially forming a triangular opening 38). In still other embodiments, a port 12 may include four or more doors 14.

When in the first position 44, the one or more doors 14 at least partially obstruct the ingress of a threaded fastener 30 into the bore 42 and further inhibit dirt or debris from entering the recess 40 and/or bore 42. In one embodiment, the one or more doors 14 may be aligned with the opening when in the first position 44, such that they provide a substantially flush continuation of the outer surface 26. This embodiment may utilize this flush port cover to minimize any boundary layer air turbulence that may otherwise be caused as air flows across the port 12. In another embodiment, the door 14 may be intentionally recessed slightly inward of the opening 38. If properly located on the club head 10, this door-configuration may cause a depression that can reduce the turbulence of the trailing airflow wake and ultimately reduce the drag forces on the club head 10. In still another embodiment, the doors 14 may sit outward of the outer surface 26, such as generally shown in FIG. 3.

When a threshold load is applied to an exterior surface of the doors 14, the one or more doors 14 may rotate into the second position 46. Such a load may be applied, for example, by a threaded fastener 30 or from a feature of the weight 32. Once rotated into the second position 46, the doors 14 may permit ingress of the threaded fastener 30 into the bore 42. In some embodiments, the bore 42 may be threaded. In some embodiments, the doors 14 may aid in facilitating the threadable engagement of the fastener 30 with the club head 10 by including a threaded surface or thread engaging feature 54 on the free end 52 of the door 14. In such an embodiment, as the door 14 rotates toward the open/second position 46, the thread engaging feature 54 may align with the fastener 30 and threadably engage with the fastener threads. The thread engaging feature 54 may be either a corner of the door that is angled to engage the threads of the fastener 30, or may include two or more edges/threads that form a more conventional thread pattern. In some embodiments, both the bore 42 and door 14 may be threaded, wherein the thread patterns align when door is fully opened into the second position 46.

Referring to FIG. 3, the one or more doors 14 may each be biased to rotate toward the first, closed position 44. This biasing may ensure that the door remains closed when not in use, even despite various impact forces being applied to the head. In one configuration, each door 14 may be biased using, for example, a spring disposed across the hinge or between a portion of the recessed surface 36 and the door 14. In another embodiment, instead of using an external/ancillary spring, each door 14 may be biased into the first position using an elasticity of the door, hinge, or body (i.e., using a material property of one or more components rather than a separate spring means). In such an embodiment, the door 14 may be attached to the body 18, for example, via a living hinge, whereby the living hinge can possess an elastic restorative quality that biases the door into the first, closed position 44. In addition to a simple biasing toward the first position 44, the port 12 may include a detent feature or break-away lock that may aid in maintaining the doors 14 in the first position 44 when not in use. Such a feature may increase the threshold load required to open the doors 14 beyond simply the applied spring force. In one configuration, the detent feature may yield upon an applied load, however, in another configuration, the detent feature may be moved out of a "locked" configuration, for example, through a magnetic repelling force applied by a magnetic fastener or driver bit.

Referring to FIG. 4, in one embodiment, the discretionary weight 32 may include a medallion that is affixed to the outer surface 26 of the club head 10 via the threaded fastener 30.

More specifically, in one configuration, the threaded fastener 30 may extend through a hole 60 in the weight 32, and may be screwed into the recessed bore 42. A head of the fastener 30 may contact a surface of the weight 32 to force the weight into contact with the outer surface 26. To minimize the amount of material required to extend outward from the outer surface 26 (or to further increase the volume of the discretionary weight 32), in some configurations, the weight 32 may include a portion 62 that extends into the recessed volume 40. The weight 32 is preferably made from a metal or metal-filled composite material that has a sufficient density to affect a weight parameter of the club head. It is most preferable for the weight to include tungsten or lead due to their comparatively high densities, however, other metals are also suitable.

FIGS. 5A-5D schematically illustrate another embodiment of a port 12 that may utilize, for example, four doors 14 that are each hingably coupled to the body 18. In such an embodiment, each door 14 may have a generally triangular shape and the plurality of doors 14 may cooperate to substantially cover a generally square or rectangular opening 38. In the illustrated embodiment, each door 14 may include a thread engaging feature 54 on a free end 52 of the door 14. In some embodiments, the thread engaging feature 54 may include two or more, three or more, or even four or more protruding edges that, when all doors are opened into the second position 46, cooperate form a thread pattern. If relying on threadable engagement with the doors 14, robust threadable engagement around the circumference of the fastener is achieved by including at least three doors.

Figure 5A:
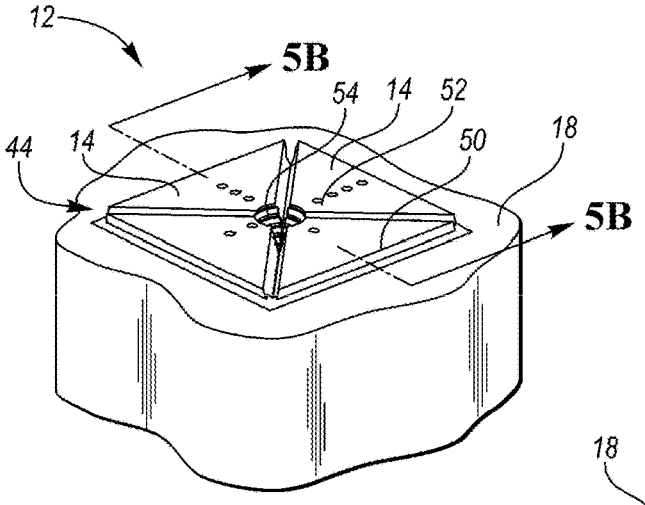
FIG. 5A is a schematic perspective view of an embodiment of a hidden screw port with four hinged doors in a closed position.
Figure 5B:
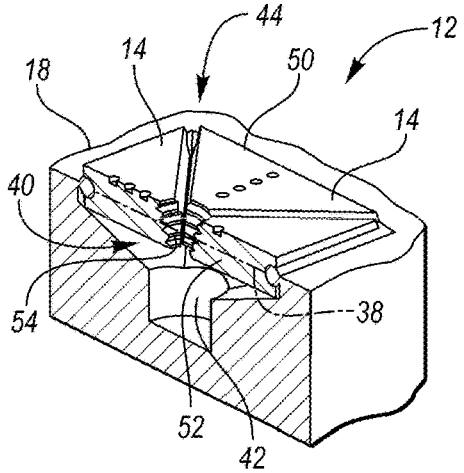
FIG. 5B is a schematic perspective cross-sectional view of the screw port of FIG. 5A, taken along line 5B-5B.
Figure 5C:
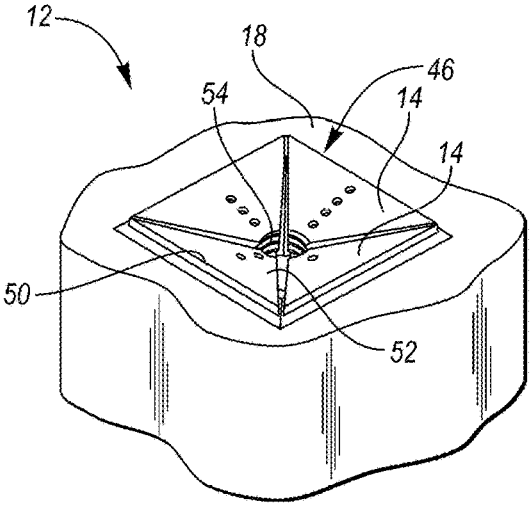
FIG. 5C is a schematic perspective view of an embodiment of the screw port of FIG. 5A in an open position.
Figure 5D:
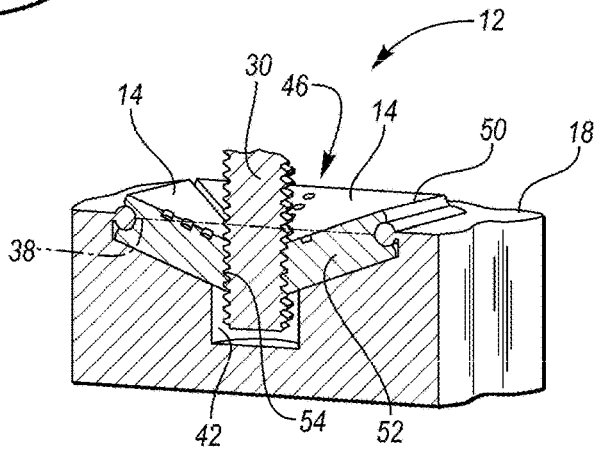
FIG. 5D is a schematic perspective cross-sectional view of the screw port of FIG. 5C with a threaded fastener threaded into a free end of the plurality of hinged doors.

FIGS. 5A and 5B generally illustrate the four-door embodiment with each of the doors 14 in the closed first position 44. Other embodiments may have 1 door, 2 doors, 3 doors, or more than 4 doors, and the doors may be any suitable shape, such as a circle. In the illustrated embodiment, the doors substantially cover the opening 38 to inhibit dirt or debris from readily becoming impacted into the bore 42. FIGS. 5C and 5D schematically illustrate the embodiment of FIG. 5A, with each of the plurality of doors 14 rotated into the open, second position 46. FIG. 5D further illustrates a threaded fastener 30 extending into the bore 44 and in threadable engagement with each of the plurality of doors 14.

In another embodiment, instead of either the bore 42 or door 14 being threaded, the bore 42 may include a quick-lock retention feature, such as described in U.S. patent application Ser. No. 14/493,495, filed on 23 Sep. 2014, now U.S. Pat. No. 9,731,171 and entitled Golf Club With Removable Weight. This patent describes a golf club with a weight port for receiving an elongated weight. The weight is secured in place through a rotation of the weight by about 90 to 180 degrees whereby a protrusion extending from the weight can push past a compliant locking feature if a sufficient amount of torque is applied to the weight. Once past the compliant locking feature, a separate ramp within the bore prevents withdrawal of the weight by interfering with the protrusion.

The present design allows a golf club head to have a plurality of available weight ports to permit a user to tune the weight parameters of the golf club, for example, by placing weights closer to the face, the user can reduce spin and loft, by placing weights closer to the toe the user can have a fade-biased club head, and by placing weights closer to the heel, the user can have a draw-biased club head. In any case, unused weight ports may be sealed via the above-described designs to prevent dirt or debris from becoming impacted into the weight-securing bore or other provided fastening means.

While the present hidden screw port design is illustrated in connection with a wood-style golf club head, it may also be utilized in an iron-type club head, a putter head, and/or in other non-golf applications.

EXAMPLE

Drag Measurement

An aerodynamic test is conducted comparing a golf club head with ports only that is similarly arranged to a golf club head 10 with ports and doors of FIG. 1. The ports are aligned proximal and parallel to the outer perimeter of both golf club heads. Each test specimen has a total of nine runs that corresponds to three different swing speed averages (80 mph, 100 mph, and 120 mph) and three different club head orientations (0°, 45°, and 90°). A 0° club head angle simulates a condition when the golf club head is just before impact and square to a given target. A 45° club head angle simulates a condition when the ball striking face of a golf club head is perpendicular to a playing surface. A 90° club head angle simulates a condition when the ball striking face of a golf club head is parallel to the playing surface. All 18 runs conducted presents a corresponding drag coefficient value. It was observed that the drag coefficient values of golf club head 10 with 120 mph swing speeds decreased between one to three percent, when compared to the golf club head with only ports. This one to three percent reduction in drag coefficient yields increased swing speeds and greater ball speeds, leading to a two-five yard increase in total ball distance.

Various features and advantages of the disclosures are set forth in the following claims.

Clause 1. A golf club head comprising: a ball striking face and a body that cooperate to define an internal volume therebetween, the body defining an outer surface and a plurality of ports that are each adapted to receive a threaded fastener, wherein each port includes: a bore recessed inward relative to the outer surface of the body, wherein the bore is fluidly isolated from the internal volume, wherein the bore is adapted to receive the threaded fastener; and a door hingably coupled to the body and pivotable between a first position that is substantially flush with the outer surface and a second position that is deflected inward of the outer surface; wherein the door at least partially blocks ingress of the threaded fastener into the bore when in the first position, and permits ingress of the threaded fastener into the bore when in the second position.

Clause 2. The golf club head of clause 1, wherein each port includes a plurality of doors, each hingably coupled to the body and pivotable between a first position that is substantially flush with the outer surface and a second position that is deflected inward of the outer surface.

Clause 3. The golf club head of clause 1, wherein each bore is threaded.

Clause 4. The golf club head of clause 1, wherein each door has a hinged end and an opposite free end, wherein the free end includes threads that are adapted to threadably engage with threads of the threaded fastener.

Clause 5. The golf club head of clause 4, wherein the free end aligns with an edge of the bore when in the second position.

Clause 6. The golf club head of clause 1, wherein each door is biased into the first position.

Clause 7. The golf club head of clause 1, wherein each door is hingably coupled to the body via a living hinge.

Clause 8. The golf club head of clause 1, wherein each door is formed from a polymeric material.

Clause 9. The golf club head of clause 1, further comprising a threaded fastener and a weight, wherein the threaded fastener extends through a hole in the weight and is threadably secured within the bore of one of the plurality of ports to secure the weight relative to the outer surface.

Clause 10. The golf club head of clause 1, wherein each port further comprises a recess defined between the threshold of the bore and the door when the door is in the first position.

Clause 11. A golf club head comprising: a ball striking face and a body extending rearward from the ball striking face, the body including: an outer surface; a recessed surface extending inward from the outer surface, wherein the recessed surface defines an opening flush with the outer surface, and wherein a recess exists between the opening and the recessed surface; and a door hingably coupled to the body and pivotable between a first position extending across at least a portion of the opening and a second position extending into the recess, wherein the door is biased to the first position.

Clause 12. The golf club head of clause 11, wherein the recessed surface defines a bore that is adapted to receive a threaded fastener.

Clause 13. The golf club head of clause 12, wherein the ball striking face and the body cooperate to define an internal volume therebetween, and wherein the bore is fluidly isolated from the internal volume.

Clause 14. The golf club head of clause 12, wherein the bore is threaded.

Clause 15. The golf club head of clause 12, further comprising a threaded fastener and a weight, wherein the threaded fastener extends through a hole in the weight and is threadably secured within the bore to secure the weight relative to the outer surface.

Clause 16. The golf club head of clause 11, wherein the door is a plurality of doors, each hingably coupled to the body and pivotable between a first position that is substantially flush with the outer surface and a second position that is deflected inward of the outer surface.

Clause 17. The golf club head of clause 11, wherein the door has a hinged end and an opposite free end, wherein the free end includes threads that are adapted to threadably engage with threads of the threaded fastener.

Clause 18. The golf club head of clause 17, wherein the free end aligns with an edge of the bore when in the second position.

Clause 19. The golf club head of clause 11, wherein the door is hingably coupled to the body via a living hinge.

Clause 20. The golf club head of clause 11, wherein the door is formed from a polymeric material.

The invention claimed is:

1. A golf club head comprising:

a ball striking face and a body that cooperate to define an internal volume therebetween, the body defining an outer surface and a plurality of ports that are each adapted to receive a threaded fastener, wherein each port includes:

a bore recessed inward relative to the outer surface of the body, wherein the bore is fluidly isolated from the internal volume, wherein the bore is adapted to receive the threaded fastener; and a door hingably coupled to the body and pivotable between a first position that is substantially flush with the outer surface and a second position that is deflected inward of the outer surface;

wherein the door at least partially blocks ingress of the threaded fastener into the bore when in the first position, and permits ingress of the threaded fastener into the bore when in the second position.

2. The golf club head of claim 1, wherein each port includes a plurality of doors, each hingably coupled to the body and pivotable between a first position that is substantially flush with the outer surface and a second position that is deflected inward of the outer surface.

3. The golf club head of claim 1, wherein each bore is threaded.

4. The golf club head of claim 1, wherein each door has a hinged end and an opposite free end, wherein the free end includes threads that are adapted to threadably engage with threads of the threaded fastener.

5. The golf club head of claim 4, wherein the free end aligns with an edge of the bore when in the second position.

6. The golf club head of claim 1, wherein each door is biased into the first position.

7. The golf club head of claim 1, wherein each door is hingably coupled to the body via a living hinge.

8. The golf club head of claim 1, wherein each door is formed from a polymeric material.

9. The golf club head of claim 1, further comprising a threaded fastener and a weight, wherein the threaded fastener extends through a hole in the weight and is threadably secured within the bore of one of the plurality of ports to secure the weight relative to the outer surface.

10. The golf club head of claim 1, wherein each port further comprises a recess defined between the threshold of the bore and the door when the door is in the first position.

11. A golf club head comprising:

a ball striking face and a body extending rearward from the ball striking face, the body including:

an outer surface;

a recessed surface extending inward from the outer surface, wherein the recessed surface defines an opening flush with the outer surface, and wherein a recess exists between the opening and the recessed surface; and a door hingably coupled to the body and pivotable between a first position extending across at least a portion of the opening and a second position extending into the recess, wherein the door is biased to the first position.

12. The golf club head of claim 11, wherein the recessed surface defines a bore that is adapted to receive a threaded fastener.

13. The golf club head of claim 12, wherein the ball striking face and the body cooperate to define an internal volume therebetween, and wherein the bore is fluidly isolated from the internal volume.

14. The golf club head of claim 12, wherein the bore is threaded.

15. The golf club head of claim 12, further comprising a threaded fastener and a weight, wherein the threaded fastener extends through a hole in the weight and is threadably secured within the bore to secure the weight relative to the outer surface.

16. The golf club head of claim 11, wherein the door is a plurality of doors, each hingably coupled to the body and pivotable between a first position that is substantially flush with the outer surface and a second position that is deflected inward of the outer surface.

17. The golf club head of claim 11, wherein the door has a hinged end and an opposite free end, wherein the free end includes threads that are adapted to threadably engage with threads of the threaded fastener.

18. The golf club head of claim 17, wherein the free end aligns with an edge of the bore when in the second position.

19. The golf club head of claim 11, wherein the door is hingably coupled to the body via a living hinge.

20. The golf club head of claim 11, wherein the door is formed from a polymeric material.

* * * * *